United States Patent [19]

Wilson, II

[11] Patent Number: 5,054,312

[45] Date of Patent: Oct. 8, 1991

[54] FUEL TANK AIR POCKET REMOVAL DEVICE

[76] Inventor: Charles N. Wilson, II, 28B Hemon Cobb, Windham, Me. 04062

[21] Appl. No.: 405,055

[22] Filed: Sep. 7, 1989

Related U.S. Application Data

[63] Continuation of Ser. No. 58,987, Jun. 8, 1987, abandoned.

[51] Int. Cl.[5] ..... B65B 31/04

[52] U.S. Cl. ..... 73/49.2; 73/49.1; 73/40; 141/59

[58] Field of Search ..... 55/55, 189; 73/40, 49.1, 73/49.2 T; 210/242.1, 242.3, 923; 254/134.3 FT; 141/59

[56] References Cited

U.S. PATENT DOCUMENTS

| | | | |
|---|---|---|---|
| 3,016,928 | 1/1962 | Brandt | 141/59 |
| 3,910,102 | 10/1975 | McLean | 73/49.2 |
| 3,922,690 | 3/1973 | Stenstrom | 210/242.3 |
| 4,224,162 | 9/1980 | Ayroldi | 210/242.1 |
| 4,332,682 | 6/1982 | Jauregui Carro | 210/242.1 |
| 4,405,458 | 9/1983 | McHugh, Jr. | 210/242.1 |
| 4,442,702 | 4/1984 | Sawada | 73/49.2 |
| 4,663,037 | 5/1987 | Breslin | 210/242.1 |
| 4,709,576 | 12/1987 | Raabe | 73/40.5 R |
| 4,763,511 | 8/1988 | Mathison et al. | 73/49.1 |
| 4,796,679 | 1/1989 | Hendershot et al. | 73/49.2 |
| 4,872,490 | 10/1989 | Geisinger | 73/49.2 T |

FOREIGN PATENT DOCUMENTS

| | | | |
|---|---|---|---|
| 7341 | 1/1985 | Japan | 73/37 |
| 2026891 | 2/1980 | United Kingdom | 55/55 |

OTHER PUBLICATIONS

Niaki et al.; Underground Tank Leak Detection Methods: A State of the Art; Hazardous waste Engineering Research Lab; Jan. 1986.

*Primary Examiner*—Hezron E. Williams
*Assistant Examiner*—Craig Miller
*Attorney, Agent, or Firm*—Lieberman Rudolph & Nowak

[57] ABSTRACT

An air pocket removal device is provided for the removal of residual air trapped in an underground fuel storage tank so that an accurate measurement can be made of the tank tightness and hence detect the presence of any leaks. The device is comprised of a guide column which can be fitted through the tank fuel inlet opening and which has an extendable hose fitted with a float which locates air pockets anywhere on the inner top surface of the tank. Any air present in the fuel storage can be withdrawn through the hose to the exterior.

21 Claims, 5 Drawing Sheets

FUEL TANK AIR POCKET REMOVAL DEVICE

This is a continuation of application Ser. No. 058,987, filed June 8, 1987, now abandoned.

FIELD OF THE INVENTION

This invention relates in general to a device for removing pockets from fuel tanks, such as those employed in underground fuel storage systems. In one aspect, this invention relates to a device for removal of air pockets in underground fuel tanks so that an accurate determination can be made as to the impermeability of such tanks and accordingly, any underground leakage may be detected. In a further aspect, the present invention relates to a snake-type siphon device which can be inserted through the fill pipe of an underground gasoline tank for the removal of air pockets which might be present, such as in a tank which has settled and is no longer in a level position.

BACKGROUND OF THE INVENTION

Fuel storage tanks, such as the gasoline storage tanks service stations, which have been in place for many years occasionally develop small leaks which due to their size can remain undetected for long periods of time. In addition to the fire hazards involved, such leaks can allow the fuel to spread underground for considerable distances and result in contamination of water supplies, infiltration of the cellars of neighboring homes or damage to surrounding soil and plant life. Moreover, with the current awareness of environmental pollution, federal, state and local agencies are now imposing strict regulations and penalties for pollution from a variety of sources, including fuel storage tanks.

The Department of Environmental Protection has requested that a method known as the Petro-tite test be employed as the accepted "tightness" test to determine the integrity of underground fuel systems. The apparatus and method are described in U.S. Pat. No. 3,910,102 and its teachings are specifically incorporated herein by reference. In practice, this test consists of filling the system to a level and recording any loss of volume from that level over a period of time. Factors, such as the recorded volume change, temperature change and tank end deflection are used to calculate any actual volume loss. This test is a very reliable one except when air pockets are present in the system, particularly in an underground storage tank. Since the measurement assumes a one hundred percent liquid filled system, the presence of an air pocket distorts the actual reading. Any air trapped in the tank acts as a spring under force and behaves differently to temperature changes than do liquids. The effect of the trapped air on the volume change necessitates removal before an accurate measurement can be made. The method usually employed for the removal of trapped air is to excavate down to the top of the tank and open a fitting to allow the air to escape. The tank is then closed and the test continued. This method is both expensive and time consuming. Accordingly, the instant invention provides an apparatus and method heretofore unknown in the industry, which removes these air pockets without costly and time consuming excavation of the buried storage tank.

It is therefore an object of this invention to provide a process and device for the removal of air pockets in underground storage tanks. Another object is to provide a process and device which can accurately locate and remove air pockets in underground storage tanks so that an accurate measurement can be made as to whether such tank is leaking. A further object of the present invention is to provide a process and device which can be employed to remove air pockets in underground fuel storage tanks without the need for excavating to the fuel tank itself. Another object of this invention is to provide a process and device which is simple and can be operated without excavation or major interruption of existing fuel dispensing facilities. These and other objects will readily become apparent to those skilled in the art in the light of the teachings herein set forth

SUMMARY OF THE INVENTION

In its broadest aspect, the present invention is directed to a device and process for the removal of air pockets from underground fuel storage tanks so that an accurate measurement of the "tightness" of the tank can be obtained using the "Petro-Tite" method. The invention permits the evacuation of these air pockets without the costly and time consuming excavation of the underground tank.

The inventive apparatus comprises a device which is used, in accordance with the inventive method, to enter the fuel inlet pipe of the underground tank and seek out the air pocket, thereby permitting it to be voided by hydrostatic pressure. A basic embodiment of the inventive device is comprised of a hollow substantially rigid guide column which is placed within the fuel inlet opening of the storage tank. Within this column is extended a flexible hose. Attached to the end of the hose inserted into the column, is a flexible tube having flotation characteristics or a float attached thereto. The guide column possesses means by which the hose can be easily directed toward any portion of the tank. Enough hose is extended through the guide column to permit the flexible tube to reach the end of the tank which contains the air pocket. The flexible tube floats to the surface of the fuel within the pocket thereby exposing the mouth of the tube to the air pocket. The air pocket then dissipates due to the pressure differential between the level of fuel below the air pocket and in the fill pipe. Suction may be used to aid this process. By slowly withdrawing the hose, the float glides along the top of the tank. In this way, any other air pockets due to irregularity in the tank surface may be withdrawn by the same procedure as above.

DESCRIPTION OF THE DRAWINGS

The objects and advantages of the process and device of the present invention will be readily apparent by reference to the drawings wherein.

DETAILED DESCRIPTION OF THE INVENTION

Figure 1:
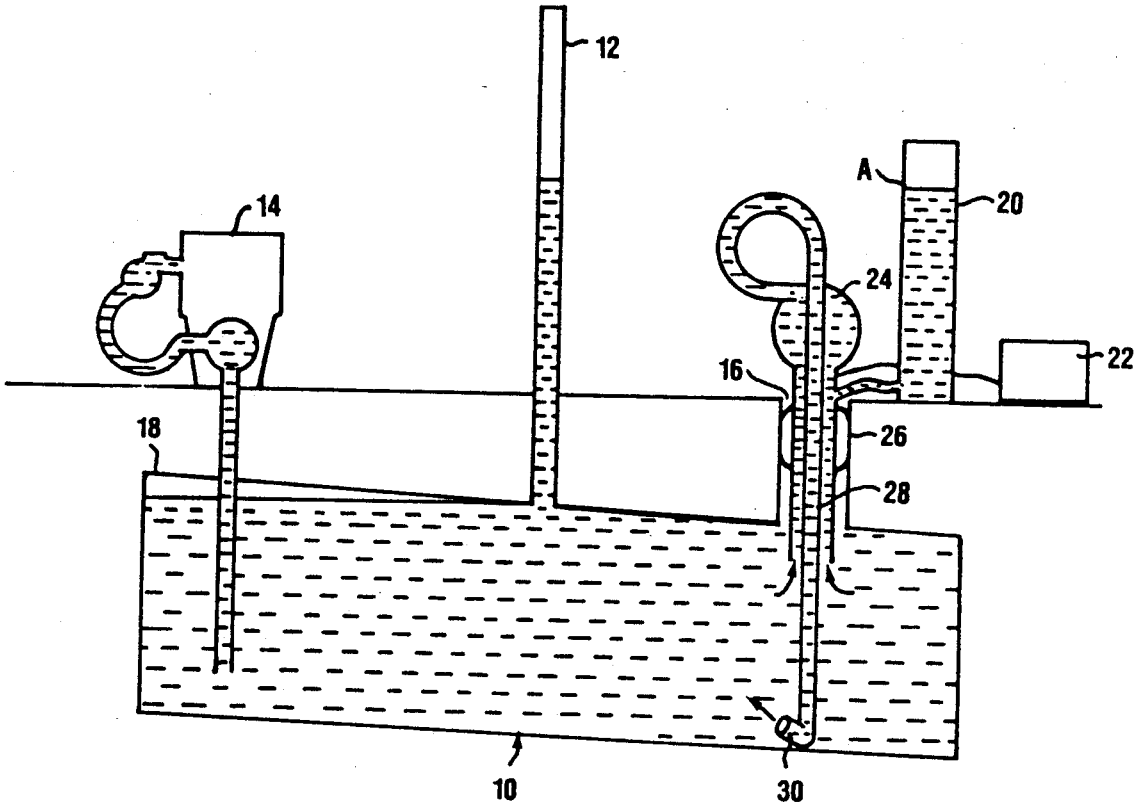
FIG. 1 is a cross-sectional view of an underground fuel storage tank which is not level and the above ground fuel dispensing means. Also shown are test means in place for measuring fuel leaks.

The present invention will be more readily understood by reference to the aforementioned drawings wherein FIG. 1 is a cross-sectional view of an underground fuel storage tank 10 fitted with vent pipe 12, fuel dispensing pump 14 and fuel inlet pipe 16.

FIG. 1 also depicts air pocket 18 due to the fact that the storage tank 10 is not level possibly due to settling of the surrounding ground support over a period of time.

FIG. 1 likewise shows Petro-Tite test equipment in place for the determination of the "tightness" of the tank. The test equipment is composed of fuel level graduate and/or stand pipe 20, fuel temperature probe 22, circulation pump 24, air bladder seal 26, circulation pump suction line 28 and circulation discharge nozzle 30. In the testing procedure, the system is filled to level A. Since the level is a hydrostatic test, there is no added pressure, only atmospheric pressure. Thereafter, fuel in the tank is circulated by pump 24 which draws fuel in at suction pump 28 and propels it through nozzle 30 thereby mixing the various temperature layers in the fuel tank and produce a more accurate temperature for fuel probe 20.

After the predetermined circulation time, volume changes for level A are recorded and the actual gain or loss per period of time can be circulated. The maximum leakage allowed under federal regulation NFRA 329 is 0.05 gallons per hour.

Figure 2:
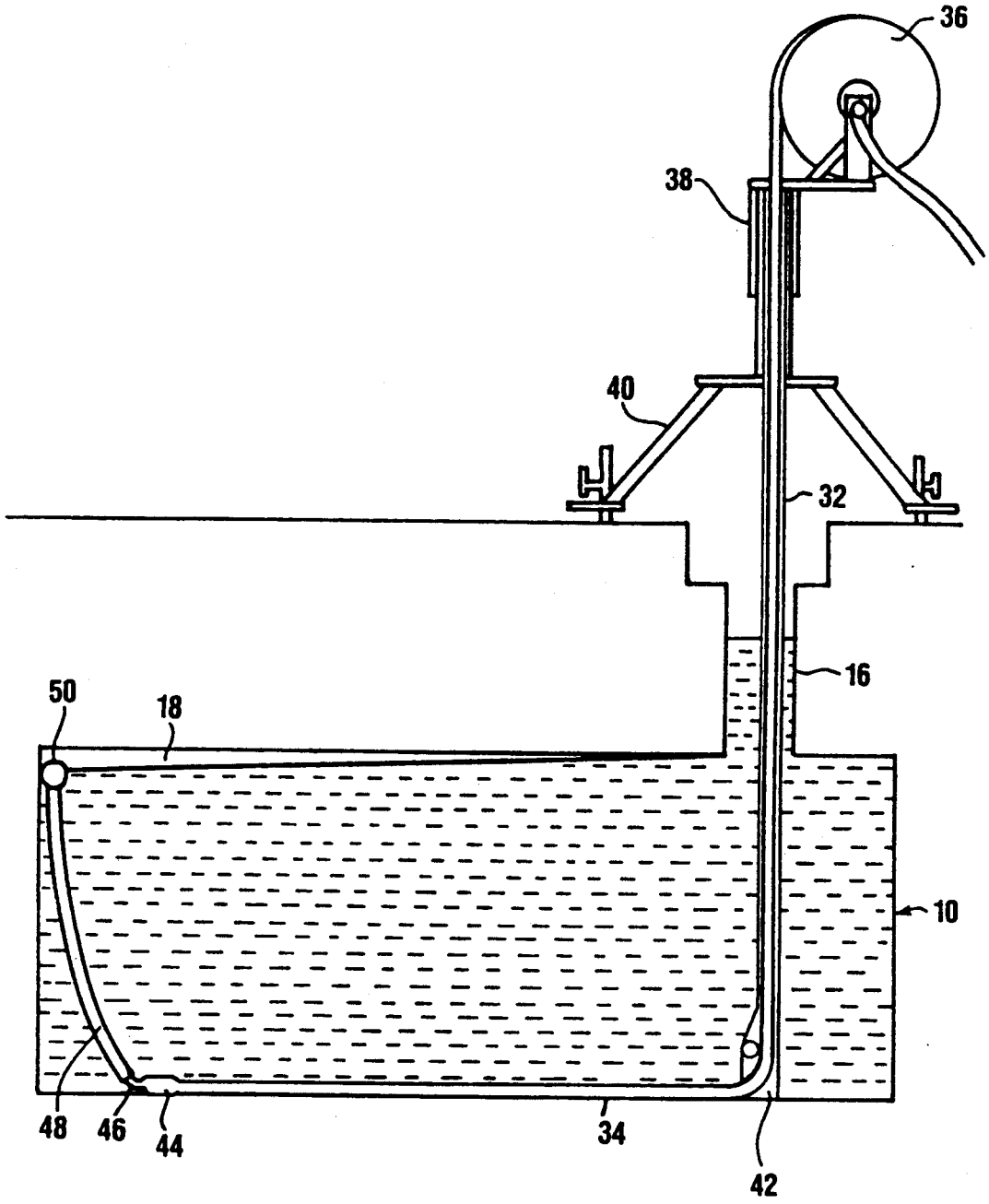
FIG. 2 is a cross-sectional view of an underground fuel storage tank with one embodiment of the device of the present invention in place for the removal of a trapped air pocket.

FIG. 2 is also a cross-sectional view of a fuel storage tank 10 showing air pocket 18 due to the tank unevenness. One embodiment of the present invention is also shown in place in FIG. 2 and is comprised of guide column 32 which has been inserted through fuel inlet pipe 16. Air hose 34 is dispensed through guide column 32 from hose reel 36 which connects with means not shown for providing suction to the air hose for removal of trapped air from air pocket 18. Hose reel 36 is mounted on the top of guide column 32 and by means of swivel assembly 38. Reel 36 can be turned through a 360 degree angle for positioning the air hose 34 to reach various sections of storage tank 10. Support means 40 maintains guide column 32 in proper positioning for extending air hose 34 into tank 10 for removal of air pocket 18.

The bottom of guide column 32 terminates in foot assembly 42 which directs air hose 34 from the vertical downward direction to a direction parallel to the bottom of fuel storage tank 10. When guide column 32 is placed in tank 10 so that foot assembly 42 rests on the bottom of the tank, extended air hose 34 will lie flat along the bottom of tank 10.

Air hose 34 terminates at nose piece 44 which connects air hose 34 with flexible hose 46 and allows hose 46 to bend in any direction. Air finder hose ,48 is connected to flexible hose 46 which is of sufficient length to reach to the top of the tank interior. Because the approximate diameter of the tank will be know, the length of air finder hose 48 can be easily estimated prior to use. Air finder hose 48 terminates in float 50 which is composed of a material which is buoyant in the fuel and which will rise in the fuel tank to air pocket 18. Float 50 has one or more openings which provide a continuous conduit from the air pocket through the various hoses to the exterior of the tank.

Figure 3:
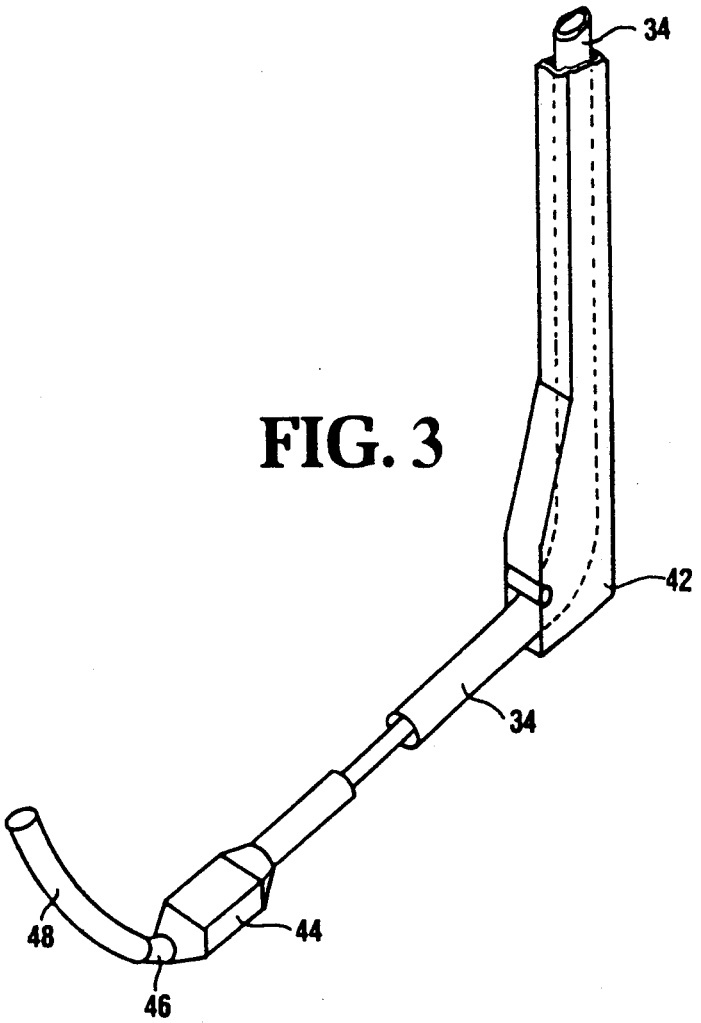
FIG. 3 is a partial view of the embodiment of FIG. 1 showing the guide column, foot assembly, spring loaded air hose, nose piece and air finder hose fitted with float.
Figure 4:
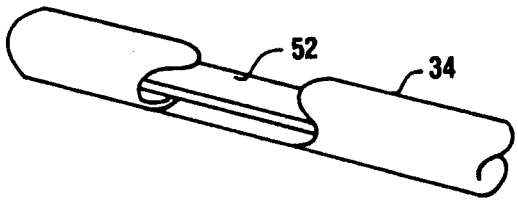
FIG. 4 is a cross-sectional view of a portion of the air hose showing a spring-loaded center piece.

FIG. 3 is a partial view of the device of the present invention showing a portion of guide column 32, foot assembly 42, air hose 34, nose piece 44, flexible hose 46 and a portion of air finder hose 48. FIG. 4 is a cross-sectional view of a portion of air hose 34 showing metal spring band 52 contained within and traversing the longitudinal axis of hose 34. The metal spring is of sufficient strength to be flexible but yet firm enough to cause the air hose 34 when extended from foot assembly 42 to maintain a level position on the tank bottom. The spring has sufficient concave tension to cause the air hose 34 and nose piece 44 to remain on the tank bottom surface. The guide column 32 can be rotated about its central axis from outside of the tank and thereby aim the foot assembly 42 in any direction within the tank interior. In practice, most storage tanks are cylindrical in shape and for all practical purpose the air hose 34 will be extended along the lowest point of the tank bottom to either end of the tank.

Figure 5:
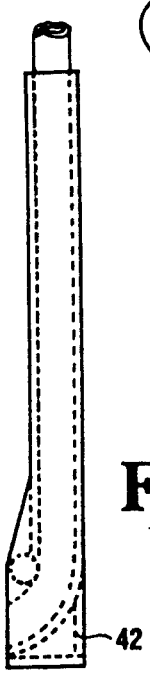
FIG. 5 is a cross-sectional view of a portion of the guide column showing the foot assembly.
Figure 5A:
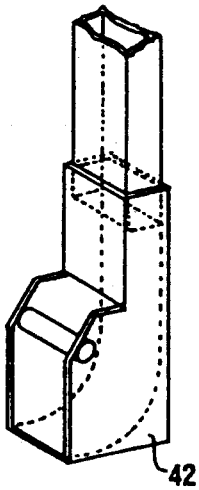
FIG. 5*a* is a plan view of the foot assembly which is attached to the end of the guide column.

FIGS. 5 and 5*a* are partial views of the foot assembly showing the circular conduit and roller bearing means which facilitates extension and retraction of air hose 34 within the storage tank.

Figure 6:
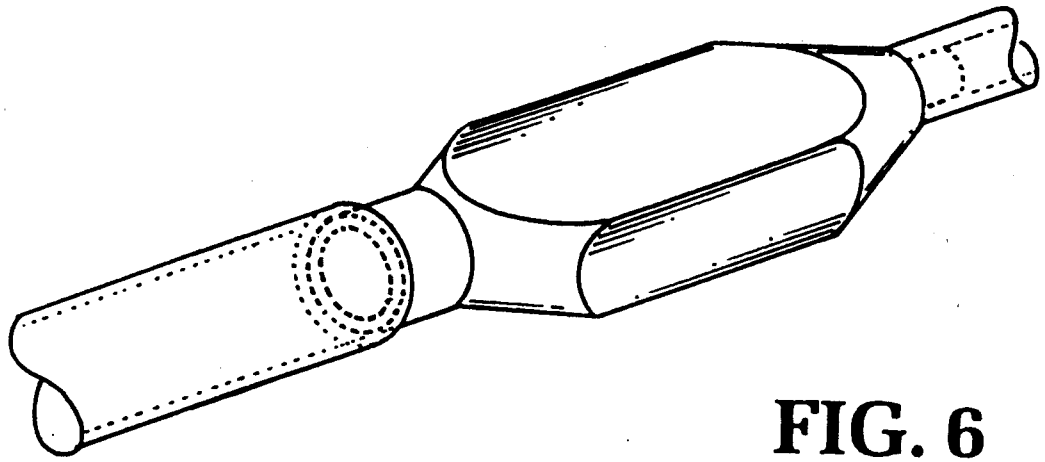
FIG. 6 is a plan view of the nose piece connecting the spring-loaded air hose to the air finder hose and float.

FIG. 6 is a plan view of the nose piece 44 which serves as the attachment point for air hose 34 and flexible hose 46 which in turn is attached to the air finder hose 48 and float 50. The air finder hose 46 is fabricated from a much lighter material than air hose 34 and is generally flexible allowing it to bend in any direction and to allow the float 50 to seek out any air pockets on the top of the interior of the tank. A variety of synthetic materials can be employed for the air finder hose as well as air hose 34 as long as such materials are inert and unaffected by the fuel stored within the tank.

Figure 7:
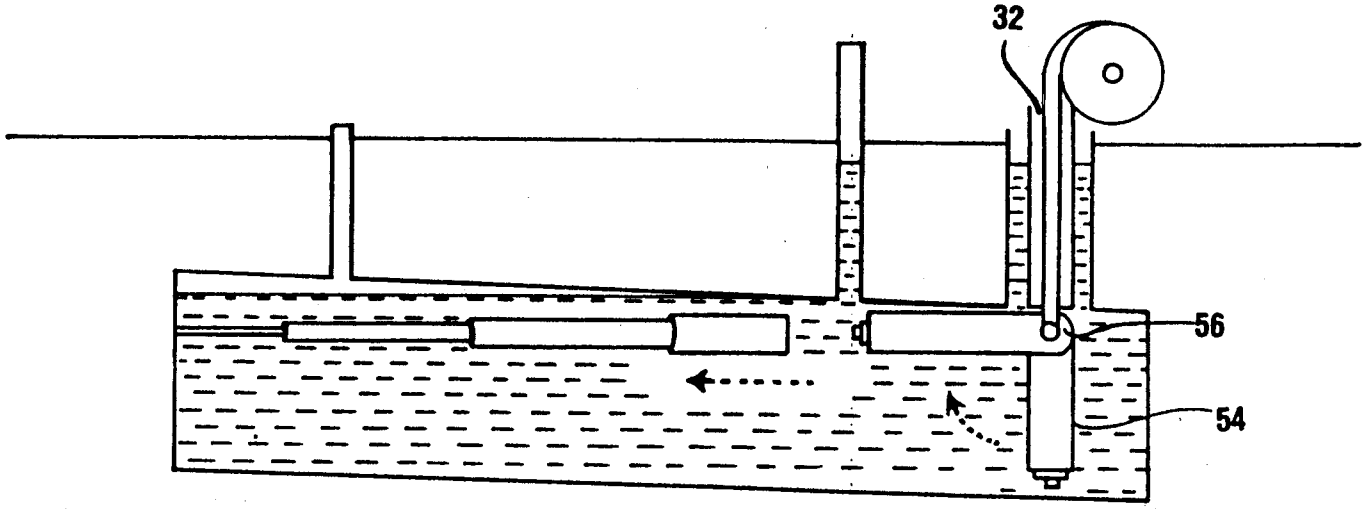
FIG. 7 is a cross-sectional view of another embodiment of the device of the present invention and shows telescopic means for removing trapped air from the fuel storage tank.

FIG. 7 is a cross-sectional view of another embodiment of the invention and shows a telescopic extension means 54 attached to the end of guide column 32 and which can be maneuvered by swivel means 56 to the horizontal position after being inserted through the fuel inlet pipe. The telescopic extension means 54 contains a plurality of interfitting sections sufficient to extend to the furthest point of the storage tank. Air hose 34, air finder hose 48 and float 50 are contained within the telescopic means 54 and accordingly can be positioned at most any point along the top of the tank.

In practice the device of the present invention is easy to use and avoids the necessity for excavation to the tank top from outside. In most cases the fuel storage tanks are buried under concrete surfaces such as a service station island, and hence it may be necessary to break through layers of concrete before commencing excavation of the soil to reach a fitting on the tank itself.

When the device is to be employed, the support means 40 is assembled together with the hose reel 36, swivel assembly 38 and connected to air suction means. Guide column 32 is fitted through the fuel inlet opening and engaged with the support means to secure it in place. The guide column can then be positioned so that the foot assembly 42 is facing in the desired direction and then extension of the air hose commenced. By extending the air hose 34, the air finder hose 48 can float freely within the tank and float 50 can rise to the top and encounter any air pocket on the tank interior surface. In order to remove an air pocket, the air hose 34 which may contain fuel must be primed first. This is done by forcing the air and fuel downward through the air hose 34 and into the air pocket. Once this occurs, the air will drain naturally through air hose 38 as long as the level of fuel in the fuel inlet pipe 16 is higher than the level of the air pocket. The air drainage ends when the levels reach equilibrium or the air pocket is completely removed. If the levels are in equilibrium, fuel is added into the fuel inlet pipe to continue air drainage through the air hose until the air is completely removed. By applying suction to the air hose 34 the air pocket can be removed even faster.

Due to irregularities which can be present within a fuel tank, more than one air pocket might appear within one tank. The instant invention provides the ability to remove these air pockets by allowing the extension or withdrawal of air hose 34 while air finder hose 48 maintains contact with the interior surface of the tank, enabling the location and evacuation of each air pocket. The air hose 34 must be primed before removal of each air pocket. After draining all the air pockets, the device is removed and the "Petro-Tite" test may be given.

Although the invention has been illustrated by the preceding description, it is not to be construed as being limited to the materials employed therein, but rather, the invention relates to the generic area as hereinbefore disclosed. Various embodiments can be made without departing from the spirit or scope thereof.

What is claimed is:

1. A device for the removal of air pockets from filled underground fuel storage tanks, which device is comprised of, in combination:

(a) a hollow rigid guide column of sufficient length to extend through a fuel inlet opening of said storage tank to the bottom thereof;

(b) a rotatable assembly affixed to the lower end of said column and containing guide means for facilitating the passage of a hose from said guide column to the most distant point of the walls of said storage tank;

(c) a hose slidably mounted within and extendable from and retractable into said guide column and having means for maintaining said air hose in a plane essentially parallel to the bottom of said storage tank;

(d) a first end of a tubular means connected to a first end of said hose, said tubular means comprising flotation means, said flotation means causing a second end of said tubular means to contact said air pocket; and (e) means on a second end of said hose for extending and retracting said hose through said guide column so as to reach any point within said storage tank.

2. The device of claim 1 wherein said guide column is a hollow metal column.

3. The device of claim 1 wherein said assembly contains an inner partially circular surface and roller guide means for directing said air hose in a direction parallel to the bottom of said storage tank.

4. The device of claim 1 wherein said hose is comprised of an inert, flexible, synthetic material.

5. The device of claim 1 wherein said hose is comprised of an inert, flexible, organic polymeric material.

6. The device of claim 1 wherein said hose contains means for maintaining said hose when extended in a position parallel to the bottom of said storage tank.

7. The device of claim 6 wherein said means are a continuous spring-metal strip contained within said hose.

8. The device of claim 7 where a suction means is attached to said second end of said hose for aiding the withdrawal of air from said air pocket.

9. The device of claim 1 wherein said rotatable assembly contains rigid, telescopic means which can be extended or retracted to any point within said storage tank and through which said hose and flexible means can be extended to reach said air pockets.

10. The device of claim 9 wherein said telescopic means are not greater in overall diameter than said guide column.

11. The device of claim 10 wherein said telescopic means can be swiveled to be in the same axis as the guide column.

12. The device of claim 11 wherein the telescopic means is comprised of metal.

13. The device of claim 12 wherein said telescopic means are extended or retracted by the action of extension or retraction of said hose through said guide column.

14. The device of claim 1 wherein the tubular means are attached to said first end of said hose by means of a nose piece.

15. The device of claim 14 wherein said nose piece is comprised of a weighted material to maintain said hose on the bottom of said storage tank.

16. The device of claim 15 wherein said tubular means is of sufficient length to extend at least from said nose piece to the top surface of said storage tank.

17. A device for the removal of air pockets from filled underground fuel storage tanks, which device is comprised of, in combination:

(a) a hollow metal guide column of sufficient diameter and length to extend perpendicularly through a fuel inlet opening of said storage tank to the bottom thereof;

(b) a rotatable assembly affixed to the lower end of said column and having an inner configuration and roller guide means for directing a hose contained within said column in a direction parallel to the bottom of said storage tank;

(c) a spring-loaded, flexible hose slidably mounted within and extendable from, said column; said hose, when extended resting on the bottom of said storage tank;

(d) a hollow nose piece attached to a first end of said hose within said tank;

(e) a light weight, flexible air finder hose having a first end attached to said now piece and communicating with said air hose through said nose piece, said air finder hose being of sufficient length to extend at least to the top of the tank;

(f) a float attached to a second end of said air finder hose and having one or more openings communicating from said float to said air finder hose; and (g) means outside of said storage tank for maintaining and positioning said guide column in order that said hose can be moved to locate said float into position for removal of air pockets from said storage tank.

18. A process for the removal of at least one air pocket in underground fuel storage tanks prior to testing such tanks for tightness, said process employing the device of claim 1, comprising the steps of:

(a) inserting into the fuel opening of an underground fuel storage tank said hollow rigid guide column and extending said column to the bottom of said tank;

(b) extending through said guide column said hose for a distance sufficient to reach a distant point within said tank;

(c) allowing sufficient time for said flotation means to cause said tubular means to reach the top inner surface of said tank; and (d) priming said hose to clear all fuel therein.

19. The process of claim 18 comprising the additional step of applying suction to said hose in order to aid the removal of any air trapped in said air pocket.

20. A process for use with an under ground fluid storage tanks, said tank having an inner top surface which extends from a first to a second end of said tank and said tank being filled with fluid, said process comprising the steps of:

(a) inserting a hose with a flotation means at its far end into a fluid inlet opening at a preselected position in the underground fluid storage tank, the hose being of sufficient length to reach said inner top surface at said first and at said second end from said preselected position;

(b) allowing sufficient time for said flotation means to cause said hose to reach the top inner surface of said tank;

(c) transporting the far end of said hose from said first end to said second end so that all vapor pockets in said tank are removed; and (d) determining the presence of any leaks in the fluid storage tank after said transporting step using testing apparatus incorporating a standpipe.

21. The process of claim 20 further including the step of priming said hose prior to said transporting step in order to remove any fluid in the hose.

* * * * *